US010519606B2

(12) United States Patent
Swails et al.

(10) Patent No.: US 10,519,606 B2
(45) Date of Patent: Dec. 31, 2019

(54) PROCESS AND SYSTEM FOR REORIENTING FIBERS IN A FOAM FORMING PROCESS

(71) Applicant: Kimberly-Clark Worldwide, Inc., Neenah, WI (US)

(72) Inventors: Marvin E. Swails, Alpharetta, GA (US); Joseph K. Baker, Cumming, GA (US); Mary F. Mallory, Atlanta, GA (US); Cleary E. Mahaffey, Canton, GA (US)

(73) Assignee: Kimberly-Clark Wordlwide, Inc., Neenah, WI (US)

( * ) Notice: Subject to any disclaimer, the term of this patent is extended or adjusted under 35 U.S.C. 154(b) by 0 days.

(21) Appl. No.: 16/318,856

(22) PCT Filed: Dec. 15, 2017

(86) PCT No.: PCT/US2017/066669

§ 371 (c)(1),
(2) Date: Jan. 18, 2019

(87) PCT Pub. No.: WO2018/118683

PCT Pub. Date: Jun. 28, 2018

(65) Prior Publication Data

US 2019/0161915 A1 May 30, 2019

Related U.S. Application Data

(60) Provisional application No. 62/437,974, filed on Dec. 22, 2016.

(51) Int. Cl.

| | |
|---|---|
| ***D21H 21/56*** | (2006.01) |
| ***D21H 27/00*** | (2006.01) |
| ***D21F 1/00*** | (2006.01) |
| ***D21F 11/00*** | (2006.01) |

(52) U.S. Cl.
CPC ..... *D21H 27/002* (2013.01); *D21F 1/009* (2013.01); *D21F 11/002* (2013.01); *D21H 21/56* (2013.01)

(58) Field of Classification Search
USPC ..... 162/109
See application file for complete search history.

(56) References Cited

U.S. PATENT DOCUMENTS

| | | | |
|---|---|---|---|
| 1,841,785 | A | 1/1932 | Bryant |
| 1,870,279 | A | 8/1932 | Bryant |
| 1,966,437 | A | 7/1934 | Bryant |
| 2,067,350 | A | 1/1937 | Schwarz |
| 2,105,711 | A | 1/1938 | Weathered |
| 3,007,840 | A | 11/1961 | Wilcox |
| 3,432,936 | A | 3/1969 | Cole et al. |
| 3,506,538 | A | 4/1970 | Friedberg et al. |
| 3,542,640 | A | 11/1970 | Friedberg et al. |
| 3,716,449 | A | 2/1973 | Gatward et al. |
| 3,839,142 | A | 10/1974 | Clarke et al. |
| 3,871,952 | A | 3/1975 | Robertson |
| 3,937,273 | A | 2/1976 | Radvan et al. |
| 3,938,782 | A | 2/1976 | Robertson |
| 3,947,315 | A | 3/1976 | Smith |
| 4,062,721 | A | 12/1977 | Guyer et al. |
| 4,166,090 | A | 8/1979 | Green et al. |
| 4,257,754 | A | 3/1981 | Green et al. |
| 4,285,757 | A | 8/1981 | Page |
| 4,299,655 | A | 11/1981 | Skaugen |
| 4,348,251 | A | 9/1982 | Pauls et al. |
| 4,385,954 | A | 5/1983 | Pauls et al. |
| 4,443,297 | A | 4/1984 | Cheshire et al. |
| 4,443,299 | A | 4/1984 | Cheshire et al. |
| 4,488,932 | A | 12/1984 | Eber et al. |
| 4,498,956 | A | 2/1985 | Cheshire et al. |
| 4,543,156 | A | 9/1985 | Cheshire et al. |
| 4,613,627 | A | 9/1986 | Sherman et al. |
| 4,686,006 | A | 8/1987 | Cheshire et al. |
| 4,764,253 | A | 8/1988 | Cheshire et al. |
| 4,882,114 | A | 11/1989 | Radvan |
| 4,913,773 | A | 4/1990 | Knudsen et al. |
| 4,944,843 | A | 7/1990 | Wallace et al. |
| 4,969,975 | A | 11/1990 | Biggs et al. |
| 5,013,405 | A | 5/1991 | Izard |
| 5,047,120 | A | 9/1991 | Izard et al. |

(Continued)

FOREIGN PATENT DOCUMENTS

| | | |
|---|---|---|
| DE | 19917809 | 11/1999 |
| EP | 2843130 | 3/2015 |
| WO | WO 1984/003112 | 8/1984 |
| WO | WO 1999/015730 | 4/1999 |
| WO | WO 1999/049118 | 9/1999 |
| WO | WO 2000/001882 | 1/2000 |
| WO | WO 2000/027625 | 5/2000 |
| WO | WO 2000/075427 | 12/2000 |
| WO | WO 2001/021873 | 3/2001 |
| WO | WO 2001/085083 | 11/2001 |
| WO | WO 2003/069038 | 8/2003 |
| WO | WO 2003/083197 | 10/2003 |

(Continued)

OTHER PUBLICATIONS

International Search Report and Written Opinion for PCT/US2017/066669 dated Apr. 5, 2018.

(Continued)

*Primary Examiner* — Mark Halpern
(74) *Attorney, Agent, or Firm* — Dority & Manning, PA

(57) ABSTRACT

A process for foam forming tissue or paper webs is disclosed. A foamed suspension of fibers is deposited onto a forming fabric and contacted with a gas flow prior to drying the web. For instance, the web can contact the gas flow prior to dewatering the web. The gas flow can have a volumetric flow rate and/or a velocity sufficient to rearrange the fibers within the web. In one embodiment, for instance, the gas flow can increase the caliper of the web, the stretch properties of the web, and/or the absorbency characteristics of the web. In one embodiment, the gas flow can be pulsed for producing a web with a distinctive pattern.

20 Claims, 2 Drawing Sheets

(56) References Cited

U.S. PATENT DOCUMENTS

| | | | |
|---|---|---|---|
| 5,106,457 | A | 4/1992 | Manning |
| 5,164,045 | A | 11/1992 | Awofeso et al. |
| 5,178,729 | A | 1/1993 | Janda |
| 5,200,035 | A | 4/1993 | Bhat et al. |
| 5,215,627 | A | 6/1993 | Willis et al. |
| 5,227,023 | A | 7/1993 | Pounder et al. |
| 5,399,241 | A | 3/1995 | Oriaran et al. |
| 5,409,572 | A | 4/1995 | Kershaw et al. |
| 5,429,686 | A | 7/1995 | Chiu et al. |
| 5,529,665 | A | 6/1996 | Kaun |
| 5,612,385 | A | 3/1997 | Ceaser et al. |
| 5,672,248 | A | 9/1997 | Wendt et al. |
| 5,720,851 | A | 2/1998 | Reiner |
| 5,904,809 | A | 5/1999 | Rökman et al. |
| 6,019,871 | A | 2/2000 | Rökman et al. |
| 6,037,282 | A | 3/2000 | Milding et al. |
| 6,080,279 | A | 6/2000 | Hada et al. |
| 6,103,060 | A | 8/2000 | Munerelle et al. |
| 6,136,153 | A | 10/2000 | Rokman et al. |
| 6,163,943 | A | 12/2000 | Johansson et al. |
| 6,174,152 | B1 | 1/2001 | Rokman et al. |
| 6,238,518 | B1 | 5/2001 | Rokman et al. |
| 6,258,203 | B1 | 7/2001 | Rokman et al. |
| 6,287,417 | B1 | 9/2001 | Bhat |
| 6,355,142 | B1 | 3/2002 | Ahrens |
| 6,368,698 | B1 | 4/2002 | Rokman et al. |
| 6,413,368 | B1 | 7/2002 | Dwiggins et al. |
| 6,444,088 | B2 | 9/2002 | Rökman et al. |
| 6,447,640 | B1 | 9/2002 | Watson et al. |
| 6,447,643 | B2 | 9/2002 | Fingal et al. |
| 6,500,302 | B2 | 12/2002 | Dwiggins et al. |
| 6,503,372 | B1 | 1/2003 | Rokman et al. |
| 6,518,479 | B1 | 2/2003 | Graef et al. |
| 6,531,078 | B2 | 3/2003 | Laine et al. |
| 6,562,193 | B1 | 5/2003 | Elonen et al. |
| 6,616,802 | B1 | 9/2003 | Kinsley, Jr. et al. |
| 6,630,054 | B1 | 10/2003 | Graef et al. |
| 6,682,215 | B2 | 1/2004 | Kinsley, Jr. et al. |
| 6,733,631 | B2 | 5/2004 | Elonen et al. |
| 6,752,907 | B2 | 6/2004 | Edwards et al. |
| 6,830,656 | B2 | 12/2004 | Kinsley, Jr. |
| 6,852,196 | B2 | 2/2005 | Capizzi |
| 6,921,459 | B2 | 7/2005 | Kinsley, Jr. et al. |
| 6,962,645 | B2 | 11/2005 | Graef et al. |
| 6,969,781 | B2 | 11/2005 | Graef et al. |
| 7,156,953 | B2 | 1/2007 | Tirimacco et al. |
| 7,166,190 | B2 | 1/2007 | Graef et al. |
| 7,326,318 | B2 | 2/2008 | Strandqvist |
| 7,416,636 | B2 | 8/2008 | Blomqvist et al. |
| 7,419,570 | B2 | 9/2008 | Chen et al. |
| 7,563,344 | B2 | 7/2009 | Beuther et al. |
| 7,691,228 | B2 | 4/2010 | Edwards et al. |
| 7,721,464 | B2 | 5/2010 | Hada et al. |
| 7,758,727 | B2 | 7/2010 | Beuther et al. |
| 7,785,443 | B2 | 8/2010 | Hermans et al. |
| 8,491,754 | B2 | 7/2013 | Araki et al. |
| 9,334,610 | B2 | 5/2016 | Kinnunen et al. |
| 9,447,543 | B2 | 9/2016 | Matula |
| 9,663,901 | B2 | 5/2017 | Heiskanen et al. |
| 9,752,280 | B2 | 9/2017 | Matula |
| 2001/0050130 | A1 | 12/2001 | Rokman et al. |
| 2002/0007169 | A1 | 1/2002 | Graef et al. |
| 2002/0055310 | A1 | 5/2002 | Falk et al. |
| 2002/0088581 | A1 | 7/2002 | Graef et al. |
| 2003/0139718 | A1 | 7/2003 | Graef et al. |
| 2004/0065420 | A1 | 4/2004 | Graef et al. |
| 2004/0096642 | A1 | 5/2004 | Maruyama et al. |
| 2004/0142620 | A1 | 7/2004 | Kinsley, Jr. |
| 2005/0022954 | A1 | 2/2005 | Strandqvist |
| 2005/0039870 | A1 | 2/2005 | Blomqvist et al. |
| 2006/0011315 | A1 | 1/2006 | Kinsley et al. |
| 2007/0151692 | A1 | 7/2007 | Beuther et al. |
| 2014/0189970 | A1 | 7/2014 | Fingal et al. |
| 2015/0284911 | A1 | 10/2015 | Juvonen et al. |
| 2015/0330029 | A1 | 11/2015 | Ramaratnam et al. |
| 2016/0186383 | A1 | 6/2016 | Jannari et al. |
| 2016/0219810 | A1 | 8/2016 | Erkkilä et al. |
| 2016/0221233 | A1 | 8/2016 | Kiiskinen et al. |
| 2017/0260694 | A1 | 9/2017 | Torniainen et al. |
| 2017/0306561 | A1 | 10/2017 | Nordström et al. |
| 2017/0335522 | A1 | 11/2017 | Heiskanen et al. |
| 2017/0362775 | A1 | 12/2017 | Juvonen et al. |
| 2018/0140529 | A1 | 5/2018 | Miller, IV et al. |
| 2018/0171560 | A1 | 6/2018 | Heiskanen et al. |

FOREIGN PATENT DOCUMENTS

| | | |
|---|---|---|
| WO | WO 2003/102302 | 12/2003 |
| WO | WO 2005/042822 | 5/2005 |
| WO | WO 2013/144449 | 10/2013 |
| WO | WO 2015/125083 | 8/2015 |
| WO | WO 2015/173474 | 11/2015 |
| WO | WO 2016/185398 | 11/2016 |
| WO | WO 2017/092791 | 6/2017 |
| WO | WO 2017/137879 | 8/2017 |
| WO | WO 2017/162927 | 9/2017 |
| WO | WO 2017/203101 | 11/2017 |
| WO | WO 2018/011667 | 1/2018 |
| WO | WO 2018/041355 | 3/2018 |
| WO | WO 2018/065668 | 4/2018 |
| WO | WO 2018/078572 | 5/2018 |
| WO | WO 2018/152082 | 8/2018 |

OTHER PUBLICATIONS

International Preliminary Report on Patentability for PCT/US2017/066669 dated Aug. 23, 2018.

"The Basics of Creping in the Tissuemaking Process", Ian Padley, Sep. 26, 2018, https://www.tissuestory.com, 8 pages.

PROCESS AND SYSTEM FOR REORIENTING FIBERS IN A FOAM FORMING PROCESS

RELATED APPLICATIONS

The present application is based upon and claims priority to PCT international Patent Application No. PCT/US2017/066669, filed on Dec. 15, 2017, which claims priority to U.S. Provisional Patent Application Ser. No. 62/437,974, filed on Dec. 22, 2016, both of which are incorporated herein by reference in their entirety.

This application is a 371 of PCT/US2017/066669 filed 15 Dec. 2017

BACKGROUND

Many tissue products, such as facial tissue, bath tissue, paper towels, industrial wipers, and the like, are produced according to a wet laid process. Wet laid webs are made by depositing an aqueous suspension of pulp fibers onto a forming fabric and then removing water from the newly-formed web. Water is typically removed from the web by mechanically pressing water out of the web which is referred to as "wet-pressing". Although wet-pressing is an effective dewatering process, during the process the tissue web is compressed causing a marked reduction in the caliper of the web and in the bulk of the web.

For most applications, however, it is desirable to provide the final product with as much bulk as possible without compromising other product attributes. Thus, those skilled in the art have devised various processes and techniques in order to increase the bulk of wet laid webs. For example, creping is often used to disrupt paper bonds and increase the bulk of tissue webs. During a creping process, a tissue web is adhered to a heated cylinder and then creped from the cylinder using a creping blade.

Another process used to increase web bulk is known as "rush transfer". During a rush transfer process, a web is transferred from a first moving fabric to a second moving fabric in which the second fabric is moving at a slower speed than the first fabric. Rush transfer processes increase the bulk, caliper and softness of the tissue web.

As an alternative to wet-pressing processes, through-drying processes have developed in which web compression is avoided as much as possible in order to preserve and enhance the bulk of the web. These processes provide for supporting the web on a coarse mesh fabric while heated air is passed through the web to remove moisture and dry the web.

Additional improvements in the art, however, are still needed. In particular, a need currently exists for an improved process that reorients fibers in a tissue web for increasing the bulk and softness of the web without having to subject the web to a rush transfer process or to a creping process.

SUMMARY

In general, the present disclosure is directed to further improvements in the art of tissue and papermaking. Through the processes and methods of the present disclosure, the properties of a tissue web, such as bulk, stretch, caliper, and/or absorbency may be improved. In particular, the present disclosure is directed to a process for forming a nonwoven web, particularly a tissue web containing pulp fibers, in a foam forming process. For example, a foam suspension of fibers can be formed and spread onto a moving porous conveyor for producing an embryonic web. In accordance with the present disclosure, the newly formed web is subjected to one or more gas streams for reorienting fibers contained in the web. The gas stream, for instance, may comprise an air stream, a steam flow, or a combination thereof.

In one embodiment, for instance, the present disclosure is directed to a process for producing a tissue product in which a foam suspension of fibers are deposited onto a moving forming fabric to form a wet web having a caliper. In accordance with the present disclosure, the wet web is contacted with a gas flow sufficient to rearrange the fibers in the wet web while the web is moving. For instance, the wet web can be contacted with the gas flow prior to dewatering the web. After the wet web is contacted with the gas flow and dewatered, the web can then be dried and collected for forming various different products. For instance, the web can be used to produce bath tissue, paper towels, other wipers such as industrial wipers, or any other suitable tissue product.

In order to form the foamed suspension of fibers, a foam can initially be formed by combining a surfactant with water. Any suitable foaming surfactant may be used, such as sodium lauryl sulfate. Fibers are then added to the foam in order to form the suspension. The foam, for instance, can have a foam density of from about 200 g/L to about 600 g/L, such as from about 250 g/L to about 400 g/L. The fibers combined with the foam, in one embodiment, can comprise at least about 50% by weight pulp fibers, such as at least about 60% by weight pulp fibers, such as at least about 70% by weight pulp fibers, such as at least about 80% by weight pulp fibers.

In one embodiment, the gas flow that contacts the wet web is configured to increase the caliper and/or the basis weight of the web in a type of foreshortening process. For instance, the gas flow can be configured to increase the caliper of the web by at least about 5%, such as by at least about 10%, such as by at least about 15% in comparison to a web formed on the exact same process without the use of the air flow. Similarly, the basis weight of the web can increase by greater than about 5%, such as greater than about 10%, such as greater than about 15%.

The gas flow can be generated by a single nozzle that extends over the width of the wet web or can be generated by a plurality of nozzles. The plurality of nozzles, for instance, can form an array that extends over the width of the web. During contact with the gas flow, the web is moving in a first direction while the gas flow is being projected in a second direction. In one embodiment, the direction of the gas flow is at a 90° angle to the direction of the moving web. In this embodiment, for instance, one or more gas nozzles are positioned directly over the moving web. In other embodiments, however, the angle between the gas flow direction and the moving web direction can be from about 90° to about 180°, such as from about 90° to about 150°. In one embodiment, the angle is from about 90° to about 100°. In another embodiment, however, the angle can be from about 120° to about 150°.

In one embodiment, the gas flow contacts the moving web in pulses. In this manner, the fibers within the web are rearranged or reoriented at spaced apart locations. In this manner, a pattern can be formed in the web as the web is moving.

After the web contacts the gas flow, the web can be dewatered and optionally subjected to a rush transfer process. The web is then dried using any suitable drying device or technique. In one embodiment, for instance, the web is through-air dried.

In general, tissue webs made according to the present disclosure have a bulk of greater than about 3 cc/g, such as greater than about 5 cc/g, such as greater than about 7 cc/g, such as greater than about 9 cc/g, such as greater than about 11 cc/g. The basis weight of the web, on the other hand, can be from about 6 gsm to about 120 gsm, such as from about 10 gsm to about 110 gsm, such as from about 10 gsm to about 90 gsm, such as from about 10 gsm to about 40 gsm.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which.

Figure 1:
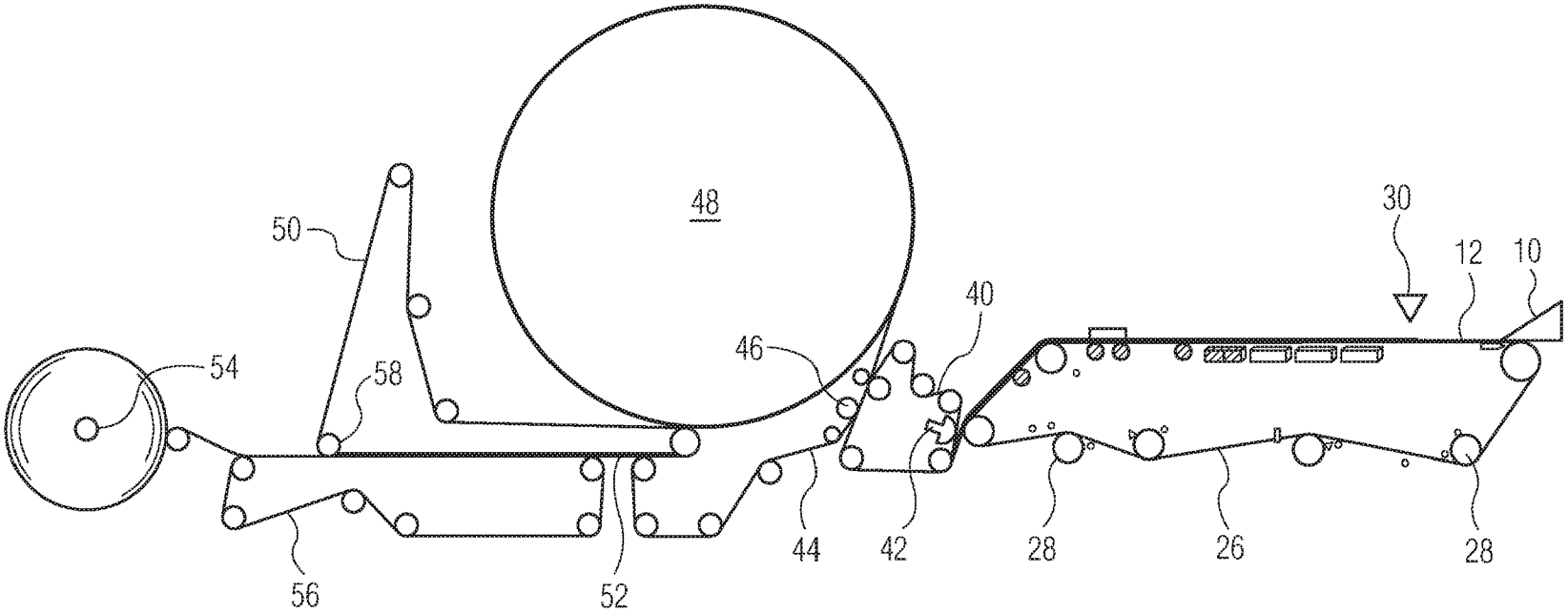
FIG. 1 is a schematic diagram of one embodiment of a process in accordance with the present disclosure for forming uncreped through-dried tissue webs.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

In general, the present disclosure is directed to the formation of tissue or paper webs having good bulk and softness properties. Through the process of the present disclosure, tissue webs can be formed, for instance, having better stretch properties, improved absorbency characteristics, increased caliper, and/or increased basis weight. In one embodiment, patterned webs can also be formed. In one embodiment, for instance, a tissue web is made according to the present disclosure from a foamed suspension of fibers. After the web is formed but prior to drying the web, the web is then subjected to a gas flow or gas stream that reorients the fibers within the web in order to improve at least one property of the web and/or produce a web having a desired appearance.

There are many advantages and benefits to a foam forming process as described above. During a foam forming process, water is replaced with foam as the carrier for the fibers that form the web. The foam, which represents a large quantity of air, is blended with papermaking fibers. Since less water is used to form the web, less energy is required in order to dry the web. For instance, drying the web in a foam forming process can reduce energy requirements by greater than about 10%, such as greater than about 20% in relation to conventional wet pressing processes.

According to the present disclosure, the foam forming process is combined with a unique fiber reorientation process for producing webs having a desired balance of properties. For instance, in one embodiment, a gas wall is produced that contacts the moving web after formation that slows down the top layer of foam and reorients the fiber. In one embodiment, for instance, stretch is created in the newly formed web without having to crepe the web. In addition to improving the stretch characteristics of the web, the process of the present disclosure can also be used to increase sheet caliper and/or water capacity. In one embodiment, the gas wall can be pulsed in order to create sheet topography for aesthetics or for sheet function purposes.

In forming tissue or paper webs in accordance with the present disclosure, in one embodiment, a foam is first formed by combining water with a foaming agent. The foaming agent, for instance, may comprise any suitable surfactant. In one embodiment, for instance, the foaming agent may comprise sodium lauryl sulfate, which is also known as sodium laureth sulfate or sodium lauryl ether sulfate. Other foaming agents include sodium dodecyl sulfate or ammonium lauryl sulfate. In other embodiments, the foaming agent may comprise any suitable cationic and/or amphoteric surfactant. For instance, other foaming agents include fatty acid amines, amides, amine oxides, fatty acid quaternary compounds, and the like.

The foaming agent is combined with water generally in an amount greater than about 2% by weight, such as in an amount greater than about 5% by weight, such as in an amount greater than about 10% by weight, such as in an amount greater than about 15% by weight. One or more foaming agents are generally present in an amount less than about 50% by weight, such as in an amount less than about 40% by weight, such as in an amount less than about 30% by weight, such as in an amount less than about 20% by weight.

Once the foaming agent and water are combined, the mixture is blended or otherwise subjected to forces capable of forming a foam. A foam generally refers to a porous matrix, which is an aggregate of hollow cells or bubbles which may be interconnected to form channels or capillaries.

The foam density can vary depending upon the particular application and various factors including the fiber furnish used. In one embodiment, for instance, the foam density of the foam can be greater than about 200 g/L, such as greater than about 250 g/L, such as greater than about 300 g/L. The foam density is generally less than about 600 g/L, such as less than about 500 g/L, such as less than about 400 g/L, such as less than about 350 g/L. In one embodiment, for instance, a lower density foam is used having a foam density of generally less than about 350 g/L, such as less than about 340 g/L, such as less than about 330 g/L. The foam will generally have an air content of greater than about 40%, such as greater than about 50%, such as greater than about 60%. The air content is generally less than about 75% by volume, such as less than about 70% by volume, such as less than about 65% by volume.

Once the foam is formed, the foam is combined with a fiber furnish. In general, any fibers capable of making a tissue or paper web or other similar type of nonwoven in accordance with the present disclosure may be used.

Fibers suitable for making tissue webs comprise any natural or synthetic cellulosic fibers including, but not limited to nonwoody fibers, such as cotton, abaca, kenaf, sabai grass, flax, esparto grass, straw, jute hemp, bagasse, milkweed floss fibers, and pineapple leaf fibers; and woody or pulp fibers such as those obtained from deciduous and coniferous trees, including softwood fibers, such as northern and southern softwood kraft fibers; hardwood fibers, such as eucalyptus, maple, birch, and aspen. Pulp fibers can be prepared in high-yield or low-yield forms and can be pulped in any known method, including kraft, sulfite, high-yield pulping methods and other known pulping methods. Fibers prepared from organosolv pulping methods can also be used.

A portion of the fibers, such as up to 50% or less by dry weight, or from about 5% to about 30% by dry weight, can be synthetic fibers such as rayon, polyolefin fibers, polyester fibers, bicomponent sheath-core fibers, multi-component binder fibers, and the like. An exemplary polyethylene fiber is Fybrel®, available from Minifibers, Inc. (Jackson City, Tenn.). Any known bleaching method can be used. Synthetic cellulose fiber types include rayon in all its varieties and other fibers derived from viscose or chemically-modified cellulose. Chemically treated natural cellulosic fibers can be used such as mercerized pulps, chemically stiffened or crosslinked fibers, or sulfonated fibers. For good mechanical properties in using papermaking fibers, it can be desirable that the fibers be relatively undamaged and largely unrefined or only lightly refined. While recycled fibers can be used, virgin fibers are generally useful for their mechanical properties and lack of contaminants. Mercerized fibers, regenerated cellulosic fibers, cellulose produced by microbes, rayon, and other cellulosic material or cellulosic derivatives can be used. Suitable papermaking fibers can also include recycled fibers, virgin fibers, or mixes thereof. In certain embodiments capable of high bulk and good compressive properties, the fibers can have a Canadian Standard Freeness of at least 200, more specifically at least 300, more specifically still at least 400, and most specifically at least 500.

Other papermaking fibers that can be used in the present disclosure include paper broke or recycled fibers and high yield fibers. High yield pulp fibers are those papermaking fibers produced by pulping processes providing a yield of about 65% or greater, more specifically about 75% or greater, and still more specifically about 75% to about 95%. Yield is the resulting amount of processed fibers expressed as a percentage of the initial wood mass. Such pulping processes include bleached chemithermomechanical pulp (BCTMP), chemithermomechanical pulp (CTMP), pressure/pressure thermomechanical pulp (PTMP), thermomechanical pulp (TMP), thermomechanical chemical pulp (TMCP), high yield sulfite pulps, and high yield Kraft pulps, all of which leave the resulting fibers with high levels of lignin. High yield fibers are well known for their stiffness in both dry and wet states relative to typical chemically pulped fibers.

The tissue web can also be formed without a substantial amount of inner fiber-to-fiber bond strength. In this regard, the fiber furnish used to form the base web can be treated with a chemical debonding agent. The debonding agent can be added to the foamed fiber slurry during the pulping process or can be added directly to the headbox. Suitable debonding agents that may be used in the present disclosure include cationic debonding agents such as fatty dialkyl quaternary amine salts, mono fatty alkyl tertiary amine salts, primary amine salts, imidazoline quaternary salts, silicone quaternary salt and unsaturated fatty alkyl amine salts. Other suitable debonding agents are disclosed in U.S. Pat. No. 5,529,665 to Kaun which is incorporated herein by reference. In particular, Kaun discloses the use of cationic silicone compositions as debonding agents.

In one embodiment, the debonding agent used in the process of the present disclosure is an organic quaternary ammonium chloride and, particularly, a silicone-based amine salt of a quaternary ammonium chloride. For example, the debonding agent can be PROSOFT® TQ1003, marketed by the Hercules Corporation. The debonding agent can be added to the fiber slurry in an amount of from about 1 kg per metric tonne to about 10 kg per metric tonne of fibers present within the slurry.

In an alternative embodiment, the debonding agent can be an imidazoline-based agent. The imidazoline-based debonding agent can be obtained, for instance, from the Witco Corporation. The imidazoline-based debonding agent can be added in an amount of between 2.0 to about 15 kg per metric tonne.

Other optional chemical additives may also be added to the aqueous papermaking furnish or to the formed embryonic web to impart additional benefits to the product and process. The following materials are included as examples of additional chemicals that may be applied to the web. The chemicals are included as examples and are not intended to limit the scope of the invention. Such chemicals may be added at any point in the papermaking process.

Additional types of chemicals that may be added to the paper web include, but is not limited to, absorbency aids usually in the form of cationic, anionic, or non-ionic surfactants, humectants and plasticizers such as low molecular weight polyethylene glycols and polyhydroxy compounds such as glycerin and propylene glycol. Materials that supply skin health benefits such as mineral oil, aloe extract, vitamin E, silicone, lotions in general and the like may also be incorporated into the finished products.

In general, the products of the present disclosure can be used in conjunction with any known materials and chemicals that are not antagonistic to its intended use. Examples of such materials include but are not limited to odor control agents, such as odor absorbents, activated carbon fibers and particles, baby powder, baking soda, chelating agents, zeolites, perfumes or other odor-masking agents, cyclodextrin compounds, oxidizers, and the like. Superabsorbent particles may also be employed. Additional options include cationic dyes, optical brighteners, humectants, emollients, and the like.

Figure 2:
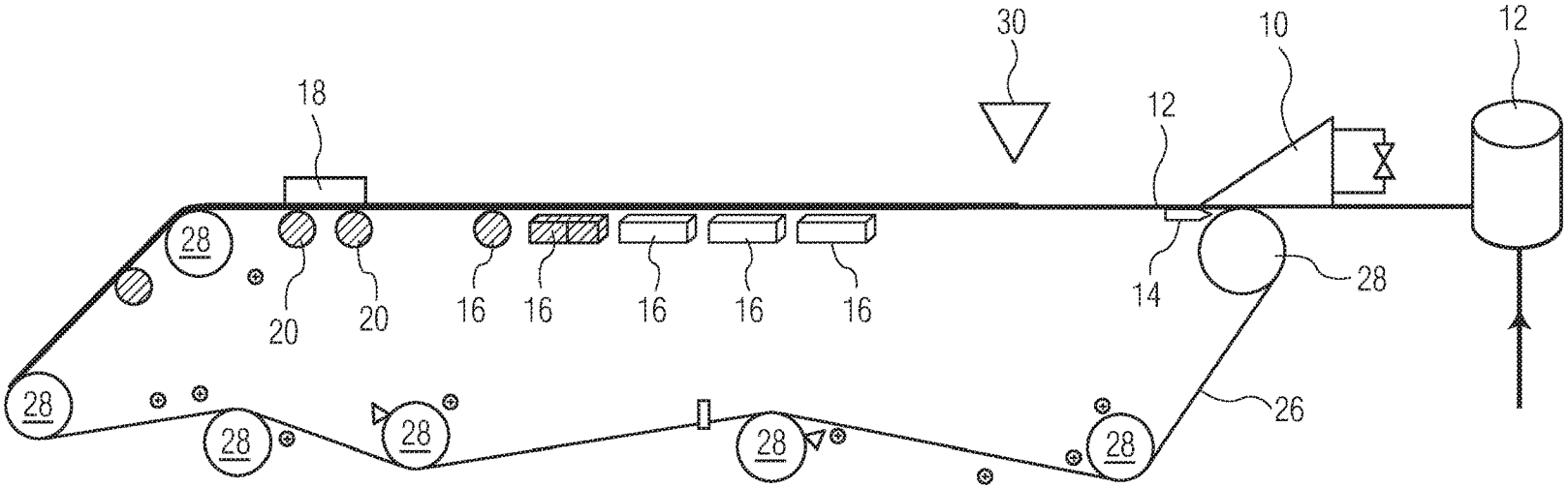
FIG. 2 is a schematic diagram of one embodiment of a headbox and forming fabric for forming wet webs in accordance with the present disclosure.

In order to form the tissue web, the foam is combined with a selected fiber furnish in conjunction with any auxiliary agents. The foamed suspension of fibers is then pumped to a tank and from the tank is fed to a headbox. FIGS. 1 and 2, for instance, show one embodiment of a process in accordance with the present disclosure for forming a tissue web. As shown particularly in FIG. 2, the foamed fiber suspension can be fed to a tank 12 and then fed to the headbox 10. From the headbox 10, the foamed fiber suspension is issued from the headbox onto an endless traveling forming fabric 26 supported and driven by rolls 28 in order to form a wet embryonic web 12. The tissue web 12 may comprise a single homogeneous layer of fibers or may include a stratified or layered construction. As shown in FIG. 2, a forming board 14 may be positioned below the web 12 adjacent to the headbox 10.

Once the wet web is formed on the forming fabric 26, the web is conveyed downstream and dewatered. For instance, the process can include a plurality of vacuum devices 16, such as vacuum boxes and vacuum rolls. The vacuum boxes assist in removing moisture from the newly formed web 12.

As shown in FIG. 2, the forming fabric 26 may also be placed in communication with a steambox 18 positioned above a pair of vacuum rolls 20. The steambox 18, for instance, can significantly increase dryness and reduce cross-directional moisture variance. The applied steam from the steambox 18 heats the moisture in the wet web 12 causing the water in the web to drain more readily, especially in conjunction with the vacuum rolls 20. From the forming fabric 26, the newly formed web 12, in the embodiment shown in FIG. 1, is conveyed downstream and dried on a through-air dryer.

In accordance with the present disclosure, the forming fabric 26 as shown in FIG. 2 is also placed in association with a gas conveying device 30. In accordance with the present disclosure, the gas conveying device 30 or nozzle emits a gas flow that contacts the wet web 12 and reorients the fibers. In the embodiment illustrated in FIG. 2, the web 12 is contacted with the gas flow prior to being dewatered by the vacuum boxes 16. Although the gas conveying device 30 may be positioned at any suitable location along the forming fabric 26, placing the gas conveying device 30 prior to the vacuum boxes 16 maximizes the amount of fiber reorientation or rearrangement that may occur.

In one embodiment, the flow of gas contacts the wet web 12 while the wet web 12 has a consistency of less than about 70%, such as less than about 60%, such as less than about 50%, such as less than about 45%, such as less than about 40%, such as less than about 35%, such as less than about 30%, such as less than about 25%, such as less than about 20%. The consistency is generally greater than about 10%, such as greater than about 20%, such as greater than about 30%.

The gas conveying device 30 emits a flow of gas that contacts the wet web 12. The gas may comprise any suitable gas at any suitable temperature. For instance, the gas may comprise air, steam or mixtures thereof. The gas stream contacts the wet web 12 in accordance with the present disclosure and the layer of gas creates a dam, pushing foam and fibers in the direction opposite of the sheet travel, reorienting the fibers. In one embodiment, for instance, the gas flow can cause the top layer of foam to move slower than the bottom layer of foam causing the caliper of the web to increase. In addition to increasing the caliper of the web, the gas flow contacting the web may cause the stretch properties of the web to increase. In addition, the absorbency characteristics of the web may also increase.

In the embodiment illustrated in FIG. 2, the gas conveying device 30 emits a gas stream directly above the moving web 12. Consequently, the gas stream contacts the web at a 90° angle. It should be understood, however, that the direction of gas flow can be controlled and changed depending upon the particular application. For instance, in other embodiments, the gas flow may be at an angle to the moving web in a direction opposite to the direction at which the web is traveling. In various embodiments, for instance, the gas flow may be at an angle to the moving web of anywhere from about 90° as shown in FIG. 2 to 180° where the flow of air is directly opposite to the direction of travel of the web. In other embodiments, the angle between the gas flow and the moving web can be from about 90° to about 110°, such as from about 90° to about 100° such that the gas flow primarily contacts the top of the moving web. In other embodiments, however, the relative angle can be from about 120° to about 180°, such as from about 120° to about 150°. In this embodiment, the gas flow is moving primarily in a direction opposite to the direction of travel of the web.

As explained above, the gas that is used to contact the moving wet web 12 can vary depending upon the particular application. In one embodiment, for instance, the gas is air. In an alternative embodiment, however, the gas may comprise a vapor, such as steam. In certain embodiments, steam may provide more control and prevent any excessive foam splashing. In still another embodiment, a mixture of air and steam may be used.

In accordance with the present disclosure, the system can include a single gas conveying device 30. For instance, the gas conveying device 30 may comprise a nozzle that extends over a substantial portion of the width of the web. For instance, in one embodiment, a single nozzle is used that extends over at least 80% of the width of the web, such as at least 90% of the width of the web, such as even greater than 100% of the width of the web. Alternatively, the system may include a plurality of gas conveying devices 30 or nozzles positioned in an array across the width of the web. Each nozzle can emit a gas flow. The nozzles can be individually controlled for increasing or decreasing gas flow in certain locations. For instance, in one embodiment, an array of nozzles may be used such that the gas flow rate is higher in the middle than at the edges of the web.

The gas flow rate contacting the wet web from the gas conveying device 30 can vary depending upon various different factors and the desired result. In one embodiment, for instance, the gas can have a volumetric flow rate of greater than about 0.5 $ft^3$/min per inch of sheet width, such as greater than about 0.8 $ft^3$/min per inch of sheet width, such as greater than about 1 $ft^3$/min per inch of sheet width, such as greater than about 1.2 $ft^3$/min per inch of sheet width, such as greater than about 1.4 $ft^3$/min per inch of sheet width, such as greater than about 1.6 $ft^3$/min per inch of sheet width, such as greater than about 1.8 $ft^3$/min per inch of sheet width. The gas flow is generally less than about 4 $ft^3$/min per inch of sheet width, such as less than about 3 $ft^3$/min per inch of sheet width, such as less than about 2.5 $ft^3$/min per inch of sheet width. In one embodiment, the gas conveying device may comprise an air knife operating at a pressure of from about 20 psi to about 60 psi.

The gas flow emitted from the gas conveying device 30 can be continuous or intermittent. For instance, in one embodiment, the gas conveying device 30 may emit a gas in pulses. A pulsed gas can be used, for instance, to create a desired topography on the surface of the web. For instance, a pulsed gas flow may create a wave-like pattern on the surface of the web. Alternatively, an array of nozzles may be used that each emit a gas in a pulsed manner. In this embodiment, localized depressions can be formed into the web that form an overall pattern. For instance, in one embodiment, the web may include an overall pattern of craters or depressions over the surface of the web.

In one embodiment, the gas flow rate being emitted by the gas conveying device 30 can be controlled in order to achieve a desired result. For example, in one embodiment, the gas flow rate and gas velocity can be adjusted in order to increase the caliper of the wet web. For example, in one embodiment, the gas flow can contact the wet web and increase the caliper by greater than about 5%, such as greater than about 10%, such as greater than about 15%, such as greater than about 20%, such as greater than about 25%, such as greater than about 30%, such as greater than about 35%, such as greater than about 40%, such as greater than about 45%, such as greater than about 50%, such as greater than about 60%, such as greater than about 70%, such as greater than about 80%, such as greater than about 90%, such as even greater than about 100%. In general, the caliper can be increased in an amount less than about 300%, such as in an amount less than about 200%, such as in an amount less than about 100%, such as in an amount less than about 50%. The difference in caliper can be measured by measuring the dried web made according to the present disclosure in comparison to a web made according to the same process without being contacted by the gas being emitted from the gas conveying device 30.

Similarly, the gas flow rate and/or velocity can also be controlled in order to adjust basis weight. For example, the basis weight of the tissue web being formed can be increased by greater than about 5%, such as greater than about 10%, such as greater than about 15%, such as greater than about 20%, such as greater than about 30%, such as greater than about 40%, such as greater than about 50%. The increase in basis weight is generally less than about 300%, such as less than about 100%, such as less than about 50%.

Once the aqueous suspension of fibers is formed into a tissue web, the tissue web may be processed using various techniques and methods. For example, referring to FIG. 1, a method is shown for making throughdried tissue sheets. (For simplicity, the various tensioning rolls schematically used to define the several fabric runs are shown, but not numbered. It will be appreciated that variations from the apparatus and method illustrated in FIG. 1 can be made without departing from the general process).

The wet web is transferred from the forming fabric 26 to a transfer fabric 40. In one embodiment, the transfer fabric can be traveling at a slower speed than the forming fabric in order to impart increased stretch into the web. This is commonly referred to as a "rush" transfer. The transfer fabric can have a void volume that is equal to or less than that of the forming fabric. The relative speed difference between the two fabrics can be from 0-60 percent, more specifically from about 15-45 percent. Transfer can be carried out with the assistance of a vacuum shoe 42 such that the forming fabric and the transfer fabric simultaneously converge and diverge at the leading edge of the vacuum slot.

The web is then transferred from the transfer fabric to the throughdrying fabric 44 with the aid of a vacuum transfer roll 46 or a vacuum transfer shoe. The throughdrying fabric can be traveling at about the same speed or a different speed relative to the transfer fabric. If desired, the throughdrying fabric can be run at a slower speed to further enhance stretch. Transfer can be carried out with vacuum assistance to ensure deformation of the sheet to conform to the throughdrying fabric, thus yielding desired bulk and appearance if desired. Suitable throughdrying fabrics are described in U.S. Pat. No. 5,429,686 issued to Kai F. Chiu et al. and U.S. Pat. No. 5,672,248 to Wendt, et al. which are incorporated by reference.

In one embodiment, the throughdrying fabric contains high and long impression knuckles. For example, the throughdrying fabric can have about from about 5 to about 300 impression knuckles per square inch which are raised at least about 0.005 inches above the plane of the fabric. During drying, the web can be further macroscopically arranged to conform to the surface of the throughdrying fabric and form a three-dimensional surface. Flat surfaces, however, can also be used in the present disclosure.

The side of the web contacting the throughdrying fabric is typically referred to as the "fabric side" of the paper web. The fabric side of the paper web, as described above, may have a shape that conforms to the surface of the throughdrying fabric after the fabric is dried in the throughdryer. The opposite side of the paper web, on the other hand, is typically referred to as the "air side". The air side of the web is typically smoother than the fabric side during normal throughdrying processes.

The level of vacuum used for the web transfers can be from about 3 to about 15 inches of mercury (75 to about 380 millimeters of mercury), preferably about 5 inches (125 millimeters) of mercury. The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

While supported by the throughdrying fabric, the web is finally dried to a consistency of about 94 percent or greater by the throughdryer 48 and thereafter transferred to a carrier fabric 50. The dried basesheet 52 is transported to the reel 54 using carrier fabric 50 and an optional carrier fabric 56. An optional pressurized turning roll 58 can be used to facilitate transfer of the web from carrier fabric 50 to fabric 56. Suitable carrier fabrics for this purpose are Albany International 84M or 94M and Asten 959 or 937, all of which are relatively smooth fabrics having a fine pattern. Although not shown, reel calendering or subsequent off-line calendering can be used to improve the smoothness and softness of the basesheet.

In one embodiment, the resulting tissue or paper web 52 is a textured web which has been dried in a three-dimensional state such that the hydrogen bonds joining fibers were substantially formed while the web was not in a flat, planar state. For example, the web 52 can be dried while still including a pattern formed into the web by the gas conveying device 30 and/or can include a texture imparted by the through-air dryer.

In general, any process capable of forming a paper web can also be utilized in the present disclosure. For example, a papermaking process of the present disclosure can utilize creping, double creping, embossing, air pressing, creped through-air drying, uncreped through-air drying, coform, hydroentangling, as well as other steps known in the art.

The basis weight of tissue webs made in accordance with the present disclosure can vary depending upon the final product. For example, the process may be used to produce bath tissues, facial tissues, paper towels, industrial wipers, and the like. In general, the basis weight of the tissue products may vary from about 6 gsm to about 120 gsm, such as from about 10 gsm to about 90 gsm. For bath tissue and facial tissues, for instance, the basis weight may range from about 10 gsm to about 40 gsm. For paper towels, on the other hand, the basis weight may range from about 25 gsm to about 80 gsm.

The tissue web bulk may also vary from about 3 cc/g to 20 cc/g, such as from about 5 cc/g to 15 cc/g. The sheet "bulk" is calculated as the quotient of the caliper of a dry tissue sheet, expressed in microns, divided by the dry basis weight, expressed in grams per square meter. The resulting sheet bulk is expressed in cubic centimeters per gram. More specifically, the caliper is measured as the total thickness of a stack of ten representative sheets and dividing the total thickness of the stack by ten, where each sheet within the stack is placed with the same side up. Caliper is measured in accordance with TAPPI test method T411 om-89 "Thickness (caliper) of Paper, Paperboard, and Combined Board" with Note 3 for stacked sheets. The micrometer used for carrying out T411 om-89 is an Emveco 200-A Tissue Caliper Tester available from Emveco, Inc., Newberg, Oreg. The micrometer has a load of 2.00 kilo-Pascals (132 grams per square inch), a pressure foot area of 2500 square millimeters, a pressure foot diameter of 56.42 millimeters, a dwell time of 3 seconds and a lowering rate of 0.8 millimeters per second.

In multiple ply products, the basis weight of each tissue web present in the product can also vary. In general, the total basis weight of a multiple ply product will generally be the same as indicated above, such as from about 15 gsm to about 120 gsm. Thus, the basis weight of each ply can be from about 10 gsm to about 60 gsm, such as from about 20 gsm to about 40 gsm.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A process for producing a tissue product comprising:

depositing a foamed suspension of fibers onto a forming fabric to form a wet web having a caliper, the wet web having a bottom layer adjacent to the forming fabric and a top layer opposite the bottom layer;

contacting the wet web with a gas flow sufficient to rearrange the fibers in the wet web while the web is moving, the gas flow being effective to cause a portion of the top layer to move slower than the bottom layer; and drying the web.

2. The process of claim 1, wherein the foamed suspension of fibers is formed by combining a foam with a fiber furnish, the foam having a density of from about 200 g/L to about 600 g/L.

3. The process of claim 2, wherein the foam is formed by combining a foaming agent with water.

4. The process of claim 3, wherein the foaming agent comprises sodium lauryl sulfate.

5. The process of claim 1, wherein the fibers contained in the web comprise at least about 50% by weight pulp fibers.

6. The process of claim 1, wherein the gas flow contacts the wet web at a flow rate sufficient to increase the caliper of the web, the caliper of the web being increased by at least about 5%, in comparison to a web formed in an identical process that is not contacted with the gas flow.

7. The process of claim 1, wherein the gas flow contacts the wet web at a flow rate sufficient to increase the basis weight of the web, the basis weight of the web being increased by at least about 5% in comparison to a web formed in an identical process that is not contacted with the gas flow.

8. The process of claim 1, wherein the wet web is moving in a first direction and the gas flow is moving in a second direction, the second direction being at an angle to the first direction and wherein the angle is from about 90° to about 180°.

9. The process of claim 8, wherein the angle between the second direction and the first direction is from about 90° to about 100°.

10. The process of claim 8, wherein the angle between the second direction and the first direction is from about 120° to about 150°.

11. The process of claim 1, wherein the gas flow contacts the wet web in pulses.

12. The process of claim 11, wherein the pulsed gas flow rearranges the fibers within the wet web at spaced apart locations.

13. The process of claim 12, wherein the pulsed gas flow forms a pattern into the wet web.

14. The process of claim 1, wherein the wet web is dewatered after being contacted with the gas flow and prior to drying the web.

15. The process of claim 1, wherein the web is dried by through-air drying.

16. The process of claim 1, wherein the dried web has a bulk of greater than about 3 cc/g.

17. The process of claim 16, wherein the dried web has a basis weight of from about 6 gsm to about 120 gsm.

18. The process of claim 1, wherein the wet web has a consistency of less than about 50% when contacted with the gas flow.

19. The process of claim 1, wherein the wet web has a width and wherein the gas flow is generated from a single nozzle that extends over at least 80% of the width of the wet web.

20. The process of claim 1, wherein the gas flow is generated by a plurality of nozzles.

* * * * *